US007794215B2

(12) United States Patent
Oglesby

(10) Patent No.: US 7,794,215 B2
(45) Date of Patent: Sep. 14, 2010

(54) HIGH PRESSURE SLURRY PLUNGER PUMP WITH CLEAN FLUID VALVE ARRANGEMENT

(75) Inventor: Kenneth Doyle Oglesby, Tulsa, OK (US)

(73) Assignee: Regency Technologies LLC, Tulsa, OK (US)

( * ) Notice: Subject to any disclaimer, the term of this patent is extended or adjusted under 35 U.S.C. 154(b) by 610 days.

(21) Appl. No.: 11/705,222

(22) Filed: Feb. 12, 2007

(65) Prior Publication Data

US 2008/0193299 A1 Aug. 14, 2008

(51) Int. Cl.
*F04B 39/00* (2006.01)
*F04B 41/00* (2006.01)

(52) U.S. Cl. ..... 417/430; 417/440; 417/442; 417/900; 92/87

(58) Field of Classification Search ..... 417/443; 92/177

See application file for complete search history.

(56) References Cited

U.S. PATENT DOCUMENTS

| | | | | | |
|---|---|---|---|---|---|
| 2,362,750 | A * | 11/1944 | Hayward | 417/559 |
| 2,367,185 | A * | 1/1945 | Cary | 92/87 |
| 3,104,619 | A | 9/1963 | Swartkout | |
| 3,749,529 | A * | 7/1973 | Cornelsen | 417/437 |
| 3,818,805 | A * | 6/1974 | Johansson | 92/13.1 |
| 3,818,807 | A * | 6/1974 | Semple | 92/86.5 |
| 4,023,469 | A | 5/1977 | Miller | |
| 4,086,029 | A * | 4/1978 | Crane et al. | 417/53 |
| 4,157,057 | A | 6/1979 | Bailey | |
| 4,378,183 | A * | 3/1983 | Ackerman | 406/109 |
| 4,476,771 | A | 10/1984 | Kao | |
| 4,519,753 | A * | 5/1985 | Kitsnik | 417/403 |
| 4,598,630 | A | 7/1986 | Kao | |
| 4,691,620 | A * | 9/1987 | Kao | 92/80 |
| 4,963,077 | A * | 10/1990 | Besic et al. | 417/437 |
| 5,701,797 | A * | 12/1997 | Mohn | 92/80 |
| 7,118,349 | B2 * | 10/2006 | Oglesby | 417/53 |
| 2005/0152787 | A1 * | 7/2005 | Oglesby | 417/18 |

FOREIGN PATENT DOCUMENTS

SU 561004 A * 7/1977

OTHER PUBLICATIONS

Derwent Abstract of SU561004A.*

* cited by examiner

*Primary Examiner*—Devon C Kramer
*Assistant Examiner*—Nathan Zollinger
(74) *Attorney, Agent, or Firm*—Head, Johnson & Kachigian, P.C.

(57) ABSTRACT

A high pressure slurry plunger pump is described which provides a clean fluid buffer around the suction and discharge valves of the pump and in some cases in the vicinity of the plunger seal mechanism in order to displace erosive slurry material and thus extend the life of the pump and improve pump efficiency.

7 Claims, 6 Drawing Sheets

HIGH PRESSURE SLURRY PLUNGER PUMP WITH CLEAN FLUID VALVE ARRANGEMENT

TECHNICAL FIELD

This invention relates to the general field of slurry pumps, and more particularly to slurry pumps having improved designs to address problems common in slurry pumps.

BACKGROUND

The petroleum, chemical, and cement industries, among others, often require the transport of slurries (solid rich liquids) as part of their process handling. Particularly when these slurry pump systems must operate at higher pressures a number of design and maintenance issues arise. Some example pumps that can handle slurries are—piston (e.g., triplex), plunger, centrifugal, diaphragm, displacement pot and progressing cavity (eg. Moyno®) types. They are driven by hydraulic (pressure) and mechanical (mostly with a power transmission rod connected to a crankshaft) means. Any of these means can be powered by a number of prime mover types (electric motor, gasoline engine, natural gas engine, etc . . . ). Only the plunger and piston positive displacement pumps and the batch displacement pot types can handle the higher-pressure needs of industry.

The problem in pumping slurries is that slurries are very erosive of the pump internal parts, especially on valves, seats, plunger, cylinders, pump heads and wherever the slurry flow direction changes and/or the slurry velocity is high, e.g. when in turbulence. The high velocities and rapid flow direction changes in a centrifugal pump, plus their inherent inefficiencies, makes centrifugal type pumps not the first choice for such high-pressure slurry applications. Progressing cavity type pumps can handle the solids content but cannot easily achieve the higher pressures desired due to the elastomer materials in the stator or pump.

The DIAjet, a batch displacement pot type by BHR, is currently available for high pressure slurry pumping. It utilizes pressurized clean fluid with a separate pump (of any type, triplex is most common) that is then pumped into a pressure pot that contains a pre-mixed batch of slurry which is then displaced and discharged from the pot. Production or continuous slurry pumping is difficult with this batch type system, since several pots are needed and they have to be alternately restocked with slurry and resealed for use.

But problems exist in pumping slurries with a positive displacement plunger or piston pump. In addition to the high velocity erosive nature of slurries, especially when flow direction changes, valving is also a problem. As a valve (inlet or discharge of type ball, flute, flapper, or other) closes, the area remaining for flow decreases and the slurry velocity increases (if rate stays the same) which increases the erosive ability of the slurry. Also a hardened steel valve closing onto a hardened steel seat with solids in between makes sealing difficult and results in damaged parts and/or lower efficiencies. The interfering solid particles can be crushed, if they are not too hard, still causing damage to valves and seats. At higher pressures and harder solid particles such interference becomes very damaging. Ceramic valves in these conditions could shatter quickly. Also, rapid velocity or flow pattern changes, as through valves seats, increases the rapid erosion wear of internal pump parts.

Another problem in all slurry pumps is when fluid motion stops and the solids fall out of the carrier fluid. Cleaning out such solids out of the pump is a problem and requires considerable work. If the solid particles would settle and congregate near the fluid end, it would allow easier cleanout of the pump and resumption of pumping.

A number of investigators have tried to address the problems of abrasive materials plugging or eroding cylinders, plungers, pistons and seals. Examples of this can be found in U.S. Pat. No. 3,104,619 to Swarthout, U.S. Pat. No. 4,023,469 to Miller, U.S. Pat. No. 4,157,057 to Bailey, U.S. Pat. Nos. 4,691,620, 4,598,630, and 4,476,771 to Kao. These investigators have developed a number of variations of flushing methods for rings and seals to keep them as free as possible of abrasive materials for longer effective operating lives.

U.S. Pat. No. 7,118,349 (Oglesby), issued to the inventor of this application, addressed the issues that are especially pertinent to a piston pump and defined a pump assembly and a method for maintaining clean fluids in the vicinity of suction and discharge valves of piston pumps.

As mentioned in a previous paragraph a plunger type of pump can also handle the higher-pressure needs of industry. A plunger type of pump can also face the problems described above related to the highly erosive nature of slurries. In a plunger pump, a volume of fluid in the cylinder is displaced by the plunger movement into the cylinder that pressurizes and expels the fluid out the discharge valve. The plunger is stroked axially through the cylinder to provide fluid inlet (as the plunger is withdrawn) and exit (as the plunger is re inserted). Unlike the piston pump, the plunger does not contact the cylinder wall at any time. A non-moving seal mechanism is connected to the cylinder at the base of the plunger and contains pressure and fluids by rings, rubber elements, ceramic elements and other packing materials. The plunger is driven by any number of means—crankshaft, power rod, cam and those are powered, in turn, by any number of prime movers. The cylinder can be made of any number of metals to contain the pressure and fluids. The plunger can be any number of metals or ceramics. The head and valves can be made of any number of metals and ceramics.

There is a need then for significant improvements in the methods and apparatus for plunger type pumps used in slurry service, particularly in addressing the problems of abrasive materials and how to keep the abrasive materials away from the seal mechanism, cylinder, plungers, suction and discharge valves of the slurry plunger pump for improved operation and longer operating life.

SUMMARY

The needs discussed above are addressed by the instant invention.

One aspect of the instant invention is a slurry pump assembly including at least: an inlet chamber connected to a slurry supply, the slurry comprised of a solid material and a slurry carrier fluid; a suction valve, downstream of the inlet chamber, for admitting fluids and solid materials into a cylinder; a plunger in the cylinder for providing fluid movement and pressure; a means for driving the plunger through a suction and discharge stroke cycle; a seal mechanism attached to the cylinder, contacting the plunger; a discharge valve connected to the cylinder for discharging pressurized materials from the cylinder; and a clean fluid valve, connected to a clean fluid supply, configured to supply clean fluid into the immediate vicinity of the suction valve and the discharge valve.

Another aspect of the invention is a slurry pump assembly including at least: an inlet chamber connected to a slurry supply, the slurry comprised of a solid material and a slurry carrier fluid; a suction valve, downstream of the inlet chamber, for admitting fluids and solid materials into a cylinder; a plunger in the cylinder for providing fluid movement and pressure; a means for driving the plunger through a suction and discharge stroke cycle; a seal mechanism attached to the cylinder, contacting the plunger; a discharge valve connected to the cylinder for discharging pressurized materials from the cylinder; and a clean fluid valve connected to a clean fluid supply configured to provide clean fluid into the cylinder at or near the seal mechanism.

Another aspect of the instant invention is a method to displace slurry material and place clean fluid across the suction and discharge valves, plunger, cylinder and seal mechanism during the stroke cycles of a slurry plunger pump assembly including at least the steps of: injecting a specific volume of a clean fluid into the immediate vicinity of the suction and discharge valves during any portion of a suction stroke cycle; and flowing a slurry consisting of a solid material and a slurry carrier fluid through the suction valve and into the cylinder during any portion of the suction stroke cycle.

Another aspect of the instant invention is a method to displace slurry material and place clean fluid across the suction and discharge valves, plunger, cylinder and seal mechanism during the stroke cycles of a slurry plunger pump assembly including at least the steps of: injecting a specific volume of a clean fluid into the immediate vicinity of the seal mechanism during any portion of a suction stroke cycle; and flowing a slurry consisting of a solid material and a slurry carrier fluid through the suction valve and into the cylinder during any portion of the suction stroke cycle.

To insure that a clear and complete explanation is given to enable a person of ordinary skill in the art to practice the invention, specific examples will be given involving applying the invention to a specific configuration of a high pressure slurry pump. It should be understood though that the inventive concept could apply to various modifications of such high pressure slurry pump systems and the specific examples are not intended to limit the inventive concept to the example application.

DETAILED DESCRIPTION

Figure 1:
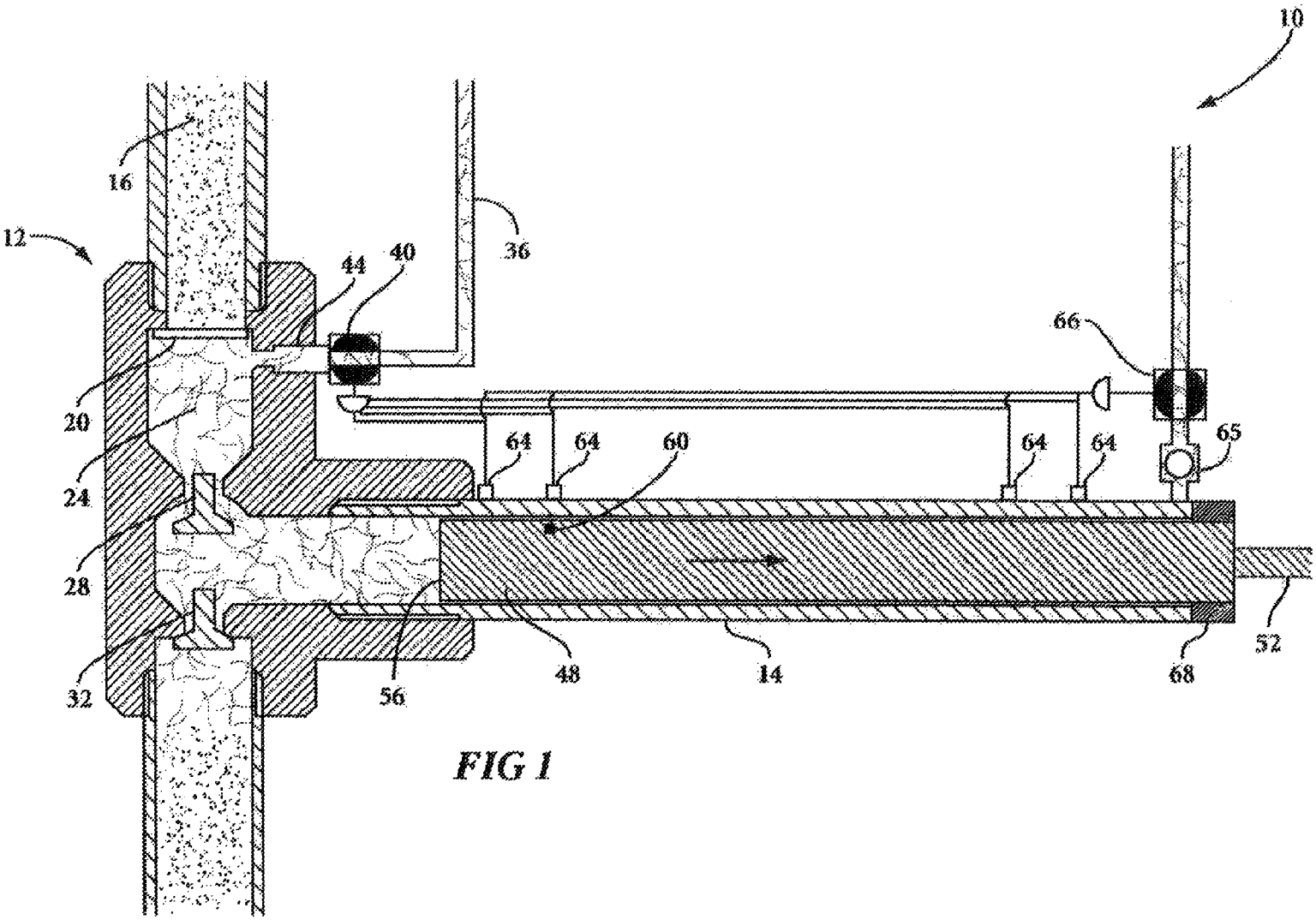
FIG. 1 is a schematic of a configuration of the high-pressure slurry pump at an early suction stroke stage.

FIG. 1 is a schematic of a configuration of a high-pressure slurry pump of the plunger type, shown generally as the numeral 10. Slurry material 16 is composed of a solid material and a slurry carrier fluid. The slurry carrier fluid could include a water-based fluid, an oil based fluid, a liquefied gas at pumping conditions, a solvent, an acid, or a base. Other chemicals may be added to viscosify or form a gel to help carry the solids or for corrosion inhibition or friction reduction or a chemical reaction (eg. a two component epoxy). A source of slurry material 16 to be pressurized and pumped is in communication with pump or slurry head 12 through valve 20. Valve 20 can be a number of types of valves. A preferred type is a spring activated flapper type valve although other valves can be useful. The pump slurry head, shown generally as the numeral 12, incorporates an inlet chamber 24, a suction valve 28, a discharge valve 32, and a clean fluid valve 40, which controls the flow of a supply of clean fluid 36 through an entry point 44. The clean fluid is provided at a higher pressure than that of the slurry material 16 during the suction stroke. Clean fluid valve 40 might be an automated control valve responsive to signals from certain sensors, or could be, for example, a check valve in combination with a choke or pipe restriction to regulate overall flow rate into the system during the suction stroke. Inlet chamber 24 may be an actual chamber although all that is required is a small region immediately ahead of suction valve 28, where either slurry material and/or clean fluid are introduced. Clean fluid entry point 44 can be in a variety of locations near to it's shown position but is generally in the immediate vicinity of the fluid end of the slurry pump that includes inlet chamber 24 and the suction 28 and discharge 32 valves. As used in this application the pump head 12 end of the pump that includes the suction 28 and discharge 32 valves is referred to as the fluid end.

Connected at pump head 12 is an elongated cylinder 14 providing a path for a driving plunger 48, which moves in a reciprocating fashion to provide the pressurizing and pumping action of the slurry material.

Plunger 48 can be driven by an external power rod, as shown by rod 52, or by crankshafts, cams, or other plungers or pistons. As used in this application this end of the pump is referred to as the power end. Any type of prime mover can ultimately provide the driving force to reciprocate the plunger. Any of these can be considered as a means for reciprocating said plunger 48 through a suction and discharge stroke cycle. A seal mechanism 68 is provided between plunger 48 and cylinder 14 at the base of plunger 48 to contain the pressure and fluids. It is connected to cylinder 14, but contacts plunger 48 during its axial movement. It can have metal or ceramic sweeps or seal rings, and other contact packing for sealing with cylinder 14 and moveable plunger 48.

Figure 2:
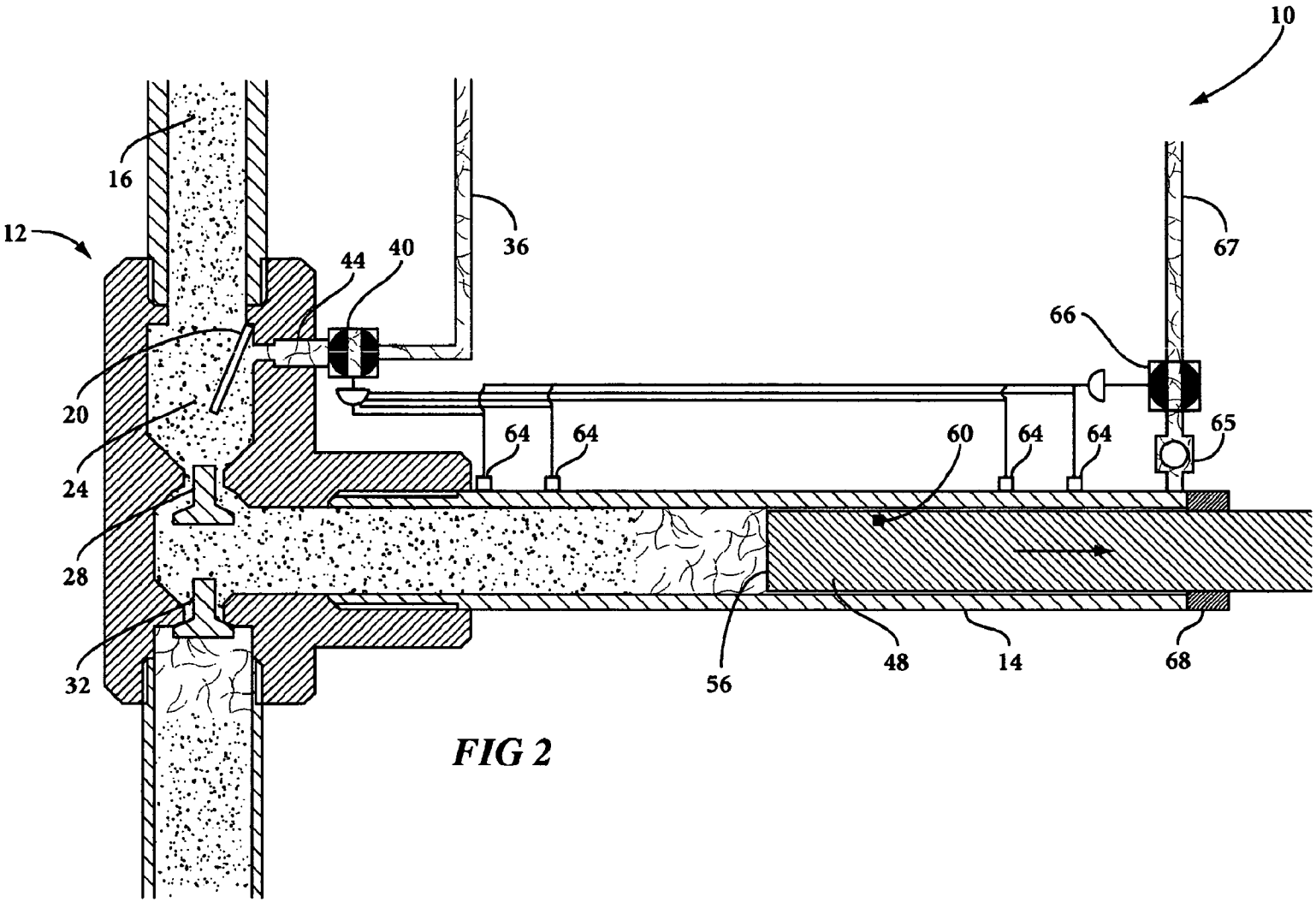
FIG. 2 is a further schematic of a configuration of the high-pressure slurry pump near the middle of the suction stroke.

Pump action utilizing the clean flush of the instant invention is shown sequentially in FIGS. 1, 2, and 3 and described as follows: A specific volume (ranging from zero to full capacity of the pump) of clean fluid is injected, via clean fluid valve 40 and channels 44 into the vicinity of suction valve 28 at any part of the suction stroke. Clean fluid valve 40 might be an automated control valve responsive to signals from certain sensors, or could be, for example, a check valve in combination with a choke or pipe restriction to regulate overall flow rate into the system during the suction stroke. FIG. 1 exhibits the beginning of the suction stroke as the plunger 48 withdraws from cylinder 14, fluids are drawn into the cylinder 14. When clean fluid 36 is injected into inlet chamber 24, spring activated flapper valve 20 closes. This allows clean fluid to be placed at the suction valve 28 when it opens. As the suction stroke cycle continues, a set volume (from zero to full pump capacity) of clean fluid injection continues and is placed in the cylinder at the plunger's 'slurry side' face 56 to provide a buffer of clean fluid to keep it clear of solids on the return stroke that would impede the plunger's 48 movement or damage the plunger 48, cylinder 14 or seal mechanism 68. Clean fluid injection stops at a set plunger position or clean fluid volume. Optionally, as seen in these figures there can also be a flushing of slurry materials from the seal mechanism 68 area via clean fluid valve 66 and check valve 65 and these can be used simultaneously with the flushing on the fluid end of the pump from clean fluid valve 40. Clean fluid valve 66 might be an automated control valve responsive to signals from certain sensors, or could be, for example, a check valve in combination with a choke or pipe restriction to regulate overall flow rate into the system during the suction stroke.

As another embodiment during the suction stroke, clean fluid valve 66 opens to allow clean fluid to flow through an optional high pressure check valve 65 and into cylinder 14 at or near the seal mechanism 68. This provides a clean fluid buffer to the seal mechanism 68, plunger 48 and cylinder 14 from slurry solids. Again clean fluid valve 66 might be an automated control valve responsive to signals from certain sensors, or could be, for example, a check valve in combination with a choke or pipe restriction to regulate overall flow rate into the system during the suction stroke.

As the suction stroke cycle continues, slurry now enters inlet chamber 24, through open slurry valve 20, through suction valve 28 and into cylinder 14. FIG. 2 shows a later part of the suction stroke cycle where slurry material from 16 is now flowing through open spring activated flapper slurry valve 20, through suction valve 28 and into cylinder 14. The initial volume of clean fluid is shown still protecting the front face 56 of plunger 48, cylinder 14 and seal mechanism 68 and clean fluid valve 66 is still open at this time.

Figure 3:
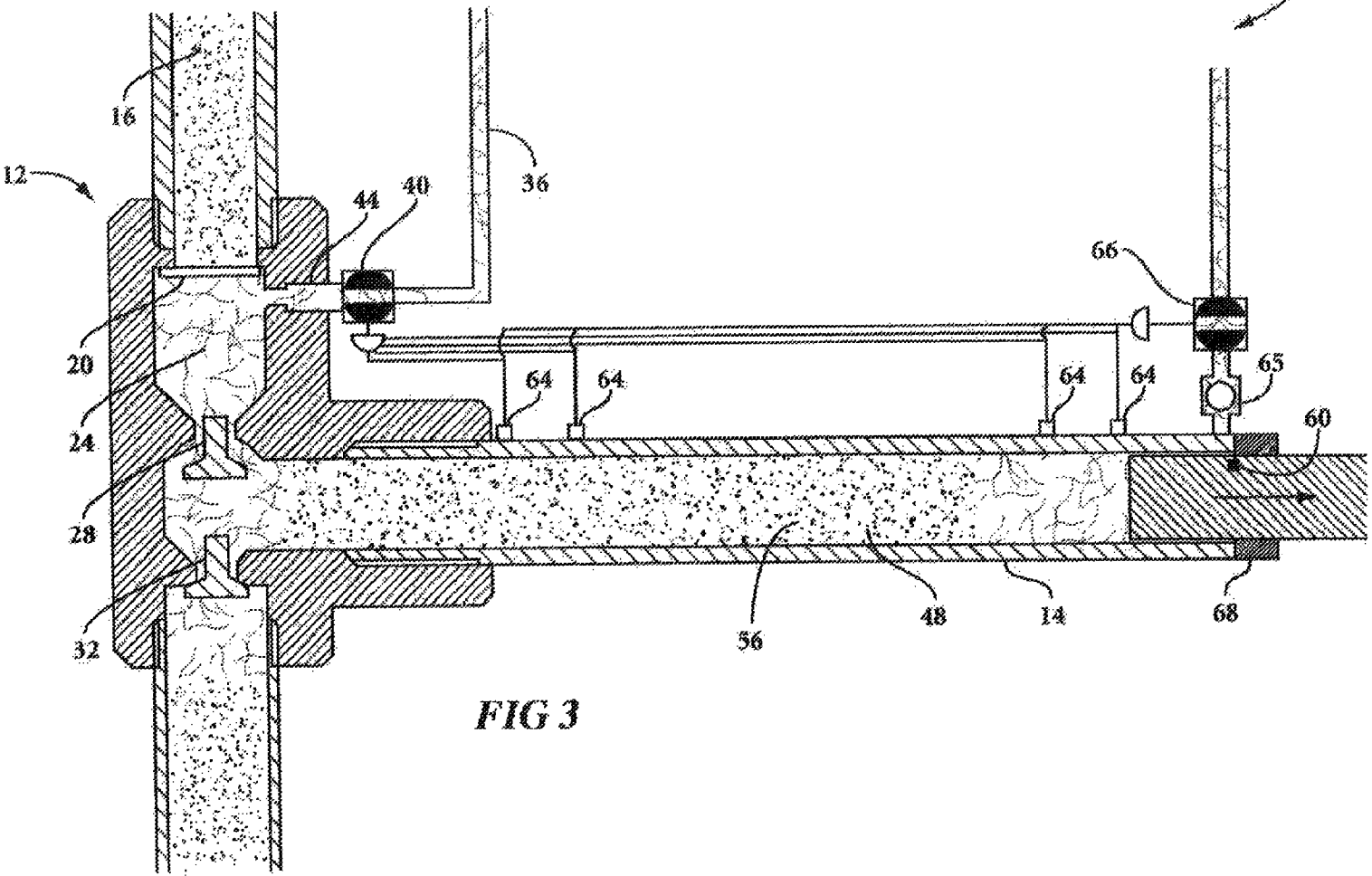
FIG. 3 is a further schematic of a configuration of the high-pressure slurry pump near the end of the suction stroke.

FIG. 3 illustrates the final part of the suction stroke where clean fluid valve 40 again opens and flapper slurry valve 20 closes, allowing clean fluid to displace slurry material through suction valve 28, clearing that valve and the pump head end 12 of slurry materials. This clean fluid allows suction valve 28 to close on clean fluid and it allows for the discharge valve 32 to open surrounded by clean fluid in the pump or slurry head 12. The location in the vicinity of suction valve 28 now also contains clean fluids to reside around the suction valve 28 while it is closed.

As the discharge cycle (not shown) begins, suction valve 28 closes due to pressure and plunger 48 advances into the cylinder 14 which discharges the final stage volume of pressurized clean fluid, followed by all of the slurry and finally the initial clean fluid flush volumes through discharge valve 32. At the end of the discharge cycle, the clean fluid injected initially via valves 40 and 66 still buffers the plunger face 56, plunger 48, cylinder 14 and seal mechanism 68 and surrounds the discharge valve 32 during its closing action with sufficient clean fluid into the discharge line.

Figure 4:
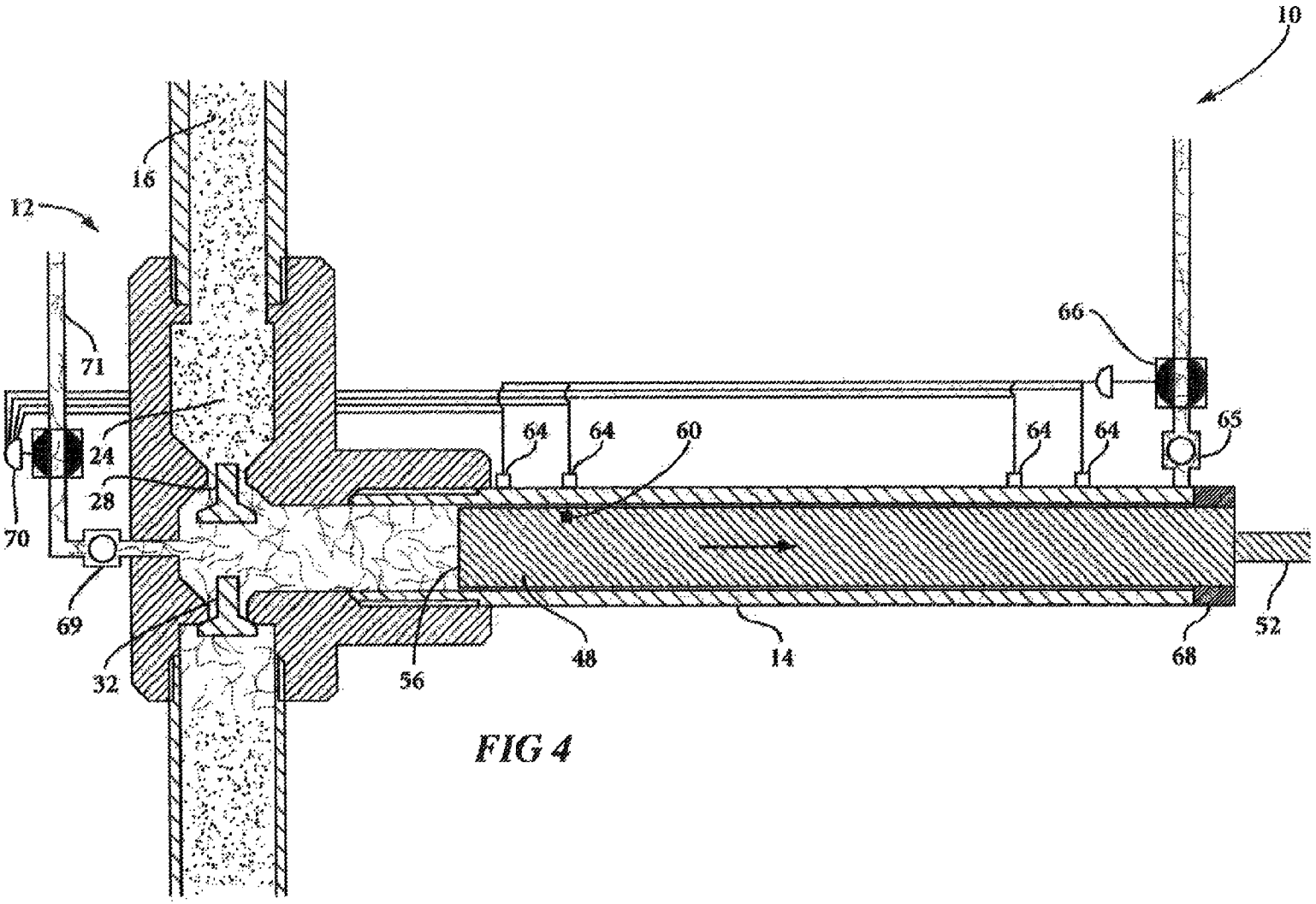
FIG. 4 is an alternate configuration of the high pressure slurry pump at an early suction stroke stage.

An alternative embodiment of using the clean fluid injection technique is shown in FIG. 4. In this embodiment clean fluid is provided from line 71 through clean fluid valve 70 and check valve 69 to also inject some clean fluid at any portion of the suction stroke to provide clean fluids traveling through suction valve 28 and discharge valve 32 during the maximum flow periods seen in crankshaft powered pumps. As mentioned earlier, the clean fluid entry point can be in a variety of locations near to it's shown position but is generally in the immediate vicinity of the fluid end of the slurry pump that includes the suction 28 and discharge 32 valves. This embodiment can allow clean fluid flushing at the beginning and end of the suction stroke as well.

In any flushing action and period, the volumes used can be from zero to full pump capacity. Flush timing and rate can be controlled to provide a steady slurry density output or maximize slurry output and density or to flush the pump for shutdown.

An embodiment showing the use of automated control valves accompanied by sensors is shown in FIGS. 1, 2, 3, and 4, where the entry of clean fluid to displace the slurry mixture is controlled by valves 40, 66, and/or 70. These clean fluid automated control valves 40, 66, and/or 70 operate based on plunger position in cylinder 14 which can be detected by any number of methods. In one embodiment of determining plunger position, sensors 64 monitor the position of plunger 48 in cylinder 14 by a transmitter 60 in plunger 48. With valve 40 in FIG. 1 open, the clean fluid flows through channel 44, into inlet chamber 24 ahead of suction valve 28 and then into cylinder 14 at specified points in the stroke cycle. Valves 28 & 32 are typically flute, ball or flapper types, but can be of any type. Control valve 66 opens in response to sensors 64 and flows clean fluids through high pressure check valve 65 into cylinder 14 at or near the seal mechanism 68.

The control, timing (on/off) and injected volume (length of time on), of this clean fluid injection/replacement is by one or more transmitters 60 on the plunger 48 and sensors 64 on the cylinder 14. In the shown position sensing method, a transmitter 60, such as a magnetic or radioactive source, is mounted in/on the plunger 48 (or crankshaft or power rod) and sensors 64 to identify and react to the plunger's 48 positions are mounted/installed on the outer wall of the cylinder 14. These sensors/instruments 64, which could be any number of types such as magnetic, mass, radioactive, or density sensors, then signal the clean fluid valves to open and/or close. As an alternative the sensors 64 may be optical sensors that may or may not require transmitters 60.

An alternate embodiment (not shown) to control clean fluid entry is for position sensors/instruments installed on a connecting rod or on the crankshaft or cam, if these exist on a given model that relates plunger 48 position within the cylinder 14. As an additional embodiment of the controlled addition of clean fluid, control valves 40, 66 and/or 70 could be controlled by sensing the crankshaft's position described above but as mechanical rotary valves operating directly off the crankshaft to deliver prescribed amounts of clean fluid during the stroke cycles.

Slurry valve 20, upstream of inlet chamber 24 is optional and only helps separate slurry from the clean fluid buffer, prevent dilution of the slurry circulation system and prevents buildup of settled slurry solids onto suction valve 28.

As an alternate embodiment, shown in FIG. 4, clean fluid valve 70 could inject clean fluids directly into pump head 12, downstream of the suction valve 28, or cylinder 14. This would provide a buffering clean fluid into the immediate vicinity of both the suction valve 28 and the discharge valve 32 and seal mechanism 68 but would require utilizing a high-pressure check valve if the clean fluid valve is not rated for the operating pressure.

Figure 5:
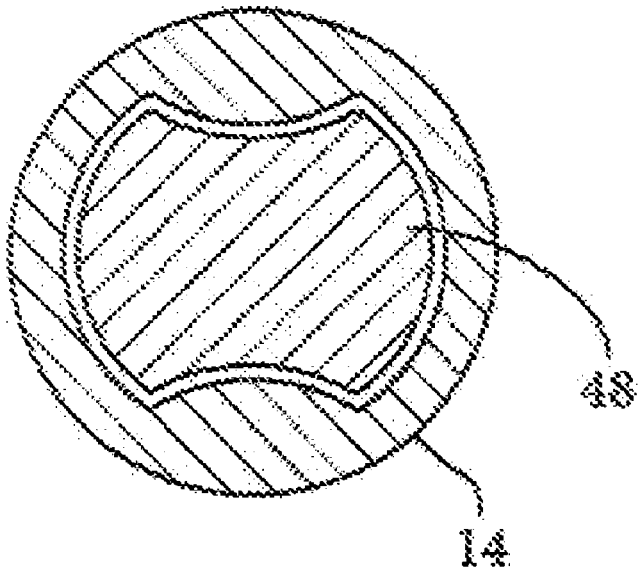
FIG. 5 is depiction of an internal helical pattern of the cylinder and plunger.

In FIG. 1 the internal surface of cylinder 14 is shown as smooth. In FIG. 5, to aid in keeping the slurry mixed during the stroke cycle, an optional internal surface of the cylinder 14 is shown in cross section that has a helical (single, double or other patterns) spiral path. For this option, a plunger 48 with an outer surface and a seal mechanism 68 with an inner pattern that both match the cylinder 14 pattern is required for maximum displacement efficiency. However, it is not required that plunger 48 pattern matches cylinder 14 as long as clearance is maintained. Plunger 48 with a matching spiral pattern must now rotate in cylinder 14 as it strokes.

Figure 6:
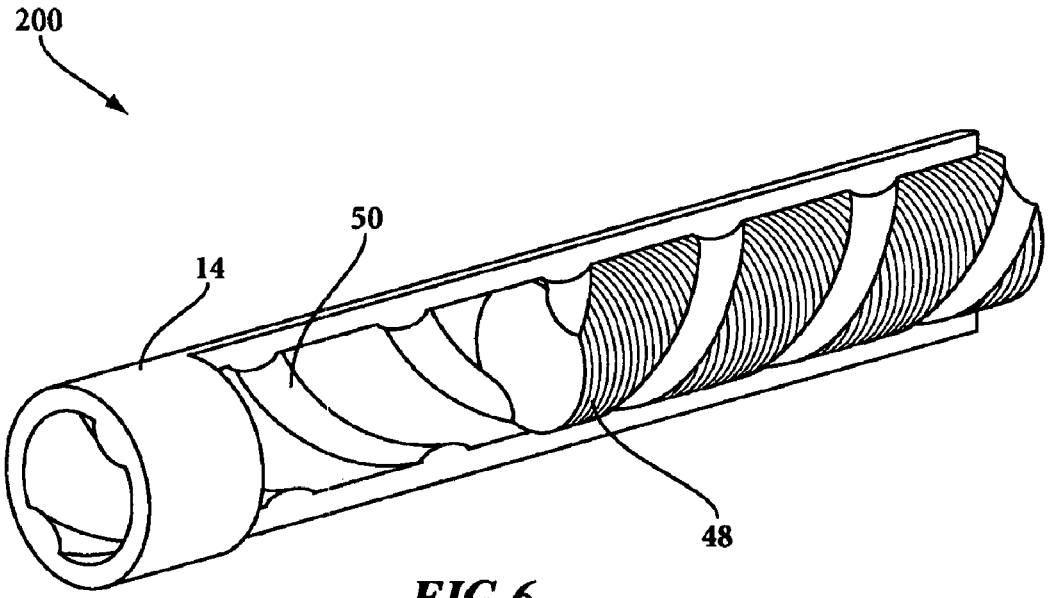
FIG. 6 is a longitudinal depiction of an internal helical pattern of the cylinder

FIG. 6 is a longitudinal view, shown generally by the numeral 200, of the embodiment of FIG. 5. The cylinder 14 in this view shows an internal surface with a helical spiral path 50. Plunger 48 has an outer surface that matches the cylinder pattern. The resulting rotation of plunger 48 helps keep the slurry mixed during the stroke cycle, especially if paddles (not shown) are attached to plunger's slurry face 56.

Since some overlap of the protective nature of each proposed flushing step occurs, the clean fluid volumes in each step can range from zero to the full rate capabilities of the pump. Judicious allocation of clean fluids in the various steps can allow for steady slurry density expelled from the pump or maximizing slurry output regardless of density or flushing the pump in preparation for shut-down.

The clean fluids can be any water (salt, fresh, brine), oil (mineral, diesel, hydrocarbon or other), liquefied gas, acid, base, solvent, or epoxy that is compatible with the carrier fluid. A viscous clean fluid stream that possesses a viscosity greater than the viscosity of the slurry carrier fluid would make the overall flushing performance more efficient by better clearing, protecting and suspending of solids out of the way of the valves 28 and 32, seal mechanism 68 and plunger 48 and cylinder 14. Less clean fluid volume is needed of a viscous clean fluid than a thinner clean fluid resulting in more slurry pumped and less wear of pump components.

Pumping carrier fluids can be water (fresh, salt, brine, or only water base) or oils (mineral, diesel, hydrocarbons), a liquefied gas at pumping conditions, a solvent, an acid, or a base and with various chemicals added for viscosifiers, gelling agents, corrosion inhibitors, friction reducers, chemical catalysts or epoxies.

By maintaining the pump assembly's pressure above certain critical pressures a number of useful gases can be maintained in their liquid fluid state and used as the slurry carrier fluid or the clean liquid. Examples of such desired phase changing fluids are carbon dioxide, halogenoalkanes (including chloroalkanes, fluoroalkanes, chloromethane, chlorofluoroalkanes, bromofluoroalkanes, hydrochloroflurocarbons), oxygen, nitrogen, chlorine, fluorine, noble gases (including helium, neon, argon), hydrocarbons (including methane and propane), ammonia, sulfur dioxide or other similar phase behaving gases/fluids. In many cases compatible gelling agents or viscosifiers would be required to suspend the slurry solids.

As an example, one desirable example could be the use of carbon dioxide —$CO_2$— as the carrier or clean fluid if the full pump assembly system is held above the critical pressure of $CO_2$. The downstream system pressure must be pre-charged/pressurized to and maintained above the critical pressure before switching to the liquid $CO_2$, or it will flash to gas in the pump, which is undesirable due to gas lock and solids settling in the pump. Pre-charging the pump and exit line to above the critical pressure entails pumping a non-volatile fluid ahead of the $CO_2$ until the pressure is acceptable or the use of a back-pressure valve positioned downstream of the pump's discharge valve. Use of liquid $CO_2$ for the slurry carrier fluid and/or the clean flush/buffer fluid would allow for a completely dry and non-combustible abrasive jetting system. Use of other flush fluids, such as water or alcohols and similar products, is also possible with $CO_2$.

Another aspect of the instant invention that can be used for both piston and plunger pumps is the positioning of the cylinder so that the fluid slurry (suction and discharge) end is below the power end of the cylinder at an angle greater than the 'angle of repose' of the slurry's solid particles that would form if flow stopped. The 'angle of repose' of solid granular particles is an engineering term that is related to the solid particle's shape, density, surface area, and coefficient of friction and is that maximum angle that will form by the settling of the solid particles. This angle is normally between 30 to 50 degrees off horizontal. By pre-positioning the slurry pump cylinder to some angle greater than 30 degrees off horizontal, with the fluid end lower than the power end, most solid particles that settle will move toward the fluid end in the event of an emergency shutdown, allowing for easier cleaning and operation restarting.

Multiple pumps in coordination (electronic, mechanical or connecting rod) are required for continuous slurry pumping, to provide a more uniform slurry density, and/or to increase the overall pumping rate over a given design. Although not shown, two or more slurry pumps of the design of the instant invention can be connected with a common means to drive both plungers to allow continuous, non-interrupted slurry pumping. An example of such combination would be triplex (3 pump assemblies) pumps utilizing a common crankshaft and prime mover.

In addition to the embodiments of this invention illustrated in the accompanying drawings and described above, it will be evident to those skilled in the art that changes and modifications may be made therein without departing from the essence of this invention. All such modifications or variations are believed to be within the sphere and scope of the invention as defined by the claims appended hereto.

The invention claimed is:

1. A slurry plunger pump assembly comprising:

a. an inlet chamber connected to a slurry supply, said slurry comprised of a solid material and a slurry carrier fluid;

b. a suction valve, downstream of said inlet chamber, for admitting, fluids and solid materials into a head end of a pump cavity;

c. a plunger in said pump cavity for providing fluid movement and pressure;

d. a means for driving said plunger through a suction and discharge stroke cycle;

e. a seal mechanism attached at an opposed end of said pump cavity from said head end, contacting said plunger during movement;

f. a discharge valve connected to said pump cavity for discharging pressurized materials from said pump cavity;

g. a first clean fluid valve connected to a clean fluid supply, configured to supply clean fluid into the inlet chamber, upstream of the suction valve; and h. a second clean fluid valve mechanism connected to a clean fluid supply configured to provide clean fluid into said pump cavity near said seal mechanism at said opposed end of said cylinder wherein said second clean fluid valve mechanism is responsive to said plunger's position and direction in said pump cavity.

2. The slurry plunger pump assembly of claim 1 wherein said clean first fluid valve is an automated control valve responsive to sensors indicating said plunger's position in said pump cavity.

3. The slurry plunger pump assembly of claim 1 wherein said slurry carrier fluid is selected from the group consisting of: a water based fluid, an oil based fluid, a liquified gas at pumping conditions, a solvent, an acid, or a base.

4. The slurry plunger pump assembly of claim 1 where said clean fluid is compatible with said slurry carrier fluid and is selected from the group consisting of: a water base fluid, an oil based fluid, a liquified gas at pumping condition, a solvent, an acid, or a base.

5. A slurry plunger pump assembly comprising:

a. an inlet chamber connected to a slurry supply, said slurry comprised of a solid material and a slurry carrier fluid;

b. a suction valve, downstream of said inlet chamber, for admitting fluids and solid materials into a head end of a pump cavity;

c. a plunger in said pump cavity for providing fluid movement and pressure;

d. a means for driving said plunger through a suction and discharge stroke cycle;

e. a seal mechanism attached at an opposed end of said pump cavity from said head end, contacting said plunger;

f. a discharge valve connected to said pump cavity for discharging pressurized materials from said pump cavity;

g. a first clean fluid valve connected to a clean fluid supply, configured to supply clean fluid into the inlet chamber; and h. a second clean fluid valve mechanism connected to a clean fluid supply configured to provide clean fluid into said pump cavity near said seal mechanism at said opposed end of said cylinder wherein said second clean fluid valve mechanism is responsive to said plunger's position and direction in said pump cavity.

6. A slurry plunger pump assembly of claim 5 wherein said slurry carrier fluid is selected from the group consisting of: a water based fluid, an oil based fluid, a liquified gas at pumping conditions, a solvent, an acid, or a base.

7. A slurry plunger pump assembly of claim 5 wherein said clean fluid is compatible with said slurry carrier fluid and is selected from the group consisting of: a water base fluid, an oil based fluid, a liquified gas at pumping condition, a solvent, an acid, or a base.

* * * * *